United States Patent [19]

Mitsuhashi et al.

[11] Patent Number: 4,938,663

[45] Date of Patent: Jul. 3, 1990

[54] AIR COMPRESSOR MALFUNCTION DETECTOR

[75] Inventors: Hiroshi Mitsuhashi; Harutsugu Ushiota; Akiharu Odagiri; Gen Kanoh; Susumu Sakamoto, all of Kanagawa, Japan

[73] Assignee: Tokico Ltd., Kanagawa, Japan

[21] Appl. No.: 312,055

[22] Filed: Feb. 17, 1989

[30] Foreign Application Priority Data

Feb. 19, 1988 [JP] Japan ..... 63-21088[U]

[51] Int. Cl.[5] ..... F04B 49/02

[52] U.S. Cl. ..... 417/44

[58] Field of Search ..... 417/12, 38, 44; 364/558

[56] References Cited

U.S. PATENT DOCUMENTS

| | | | |
|---|---|---|---|
| 2,946,203 | 7/1960 | Carver | 62/230 |
| 4,077,747 | 3/1978 | Burenga | 417/234 |
| 4,676,914 | 6/1987 | Mills et al. | 417/12 |
| 4,756,669 | 7/1988 | Hata | 417/12 |

FOREIGN PATENT DOCUMENTS

| | | |
|---|---|---|
| 1503466 | 11/1970 | Fed. Rep. of Germany . |
| 1943936 | 3/1971 | Fed. Rep. of Germany . |

OTHER PUBLICATIONS

German Journal: "Industriekurier", No. 149 of Sep. 27, 1961, p. 614.

*Primary Examiner*—Leonard E. Smith
*Assistant Examiner*—David W. Scheuermann
*Attorney, Agent, or Firm*—Wenderoth, Lind & Ponack

[57] ABSTRACT

A compressor which is provided with a safety device so that it is possible to detect occurrence of a primary accident, for example, breakage of a connecting rod, in the early stage. The compressor has a pressure sensor installed at a predetermined position in the compressor to detect the level of pressure at that position, a memory means for storing the behavior of the pressure change at the predetermined position that is obtained when the compressor is running in a normal state, a means for judging the behavior of the pressure change actually taking place at the predetermined position on the basis of an output from the pressure sensor and making a comparison between the actual pressure change behavior and the pressure change behavior in the normal state that is stored in the memory means, and a means for suspending the compressor when the actual pressure change behavior is different from the pressure change behavior in the normal state. Thus, it is possible to reliably prevent occurrence of a secondary accident which may invite a serious accident and hence possible to enhance the safety and reliability of the compressor.

7 Claims, 6 Drawing Sheets

AIR COMPRESSOR MALFUNCTION DETECTOR

BACKGROUND OF THE INVENTION

1. Field of the Invention

The present invention relates to a compressor and, more particularly, to a compressor which is designed so that it is possible to detect occurrence of an accident, for example, breakage of a connecting rod, in the early stage of an accident occuring.

2. Description of the Prior Art

There is one type of compressor, known as reciprocating compressor, which has at least one cylinder fitted with a piston which is driven to reciprocate through a connecting rod by a crankshaft rotated by a driving means such as a motor to thereby discharge compressed air. In this type of compressor, if the cylinder is not firmly secured to the crankcase due to a failure in the tightening of a clamping bolt, the cylinder vibrates to invite breakage of the connecting rod. Further, the top of the cylinder is provided with air valves which operate in response to the suction and discharge of air, and these air valves may be broken due to fatigue.

If running of the compressor is continued even after such an accident has occurred, the free end of the broken connecting rod may hit the crankcase violently, or the pressure inside the cylinder may become abnormarily high, and there is therefore a fear that a secondary accident, for example, breakage of the crankcase, may be invited.

Conventional compressors are not provided with any means for directly detecting occurrence of such an accident and it is therefore common practice that the operator suspends the compressor by a manual operation when becoming aware of the occurrence of an accident through an abnormal noise generated as a result of the failure.

In order to reliably prevent occurrence of a secondary accident such as that described above, it is essential to detect occurrence of a primary accident, such as breakage of a connecting rod, in the early stage of such an accident occuring and suspend the running of the compressor immediately.

SUMMARY OF THE INVENTION

In view of the above-described circumstances, it is a primary object of the present invention to provide a compressor which is designed so that it is possible to prevent occurrence of a secondary accident. More specifically, noting that the behavior of the change in pressure at a predetermined position in the compressor after a primary accident has occurred is different from that in the case when the compressor is running in a normal state, the compressor is arranged such that running is suspended when an abnormal change is detected in the pressure change behavior, thereby enabling the running of compressor to be suspended in the early stage of occurrence of a primary accident and thus preventing occurrence of a secondary accident.

To this end, the present invention provides a compressor comprising: a pressure sensor installed at a predetermined position in the compressor to detect the level of pressure at that position; a memory means for storing the behavior of the pressure change at the predetermined position that is obtained when the compressor is running in a normal state; a means for judging the behavior of the pressure change actually taking place at the predetermined position on the basis of an output from the pressure sensor and making a comparison between the actual pressure change behavior and the pressure change behavior in the normal state that is stored in the memory means; and a means for suspending the running of the compressor when the actual pressure change behavior is different from the pressure change behavior in the normal state.

In a compressor, for example, a reciprocating compressor, compressed air is produced by the steady reciprocating motion of a piston fitted in a cylinder and the compressed air is delivered to a tank through a discharge line so as to be accumulated therein. Therefore, when the compressed air is delivered to the tank through the discharge line by the action of the piston, the pressures inside the tank and the discharge line rise. On the other hand, when the piston is operating in the suction stroke, the pressure inside the discharge line lowers. When the compressor is in a normal running state such as that described above, the piston performs a steady reciprocating motion and, therefore, the pressures inside the discharge line and the tank change steadily.

Accordingly, if a change in the pressure inside the tank, for example, is detected with a sensor and that detected pressure change is compared with a set level for the normal running state, it is possible to find an abnormality in the compressor, that is, a primary accident.

If the sensor is connected to a means for suspending the running of the compressor when an abnormality occurs, the compressor is suspended in the early stage of the occurrence of an abnormality. Therefore, it is possible to reliably prevent occurrence of a secondary accident.

Further, a steady change in the pressure which is caused by the reciprocating motion of the piston takes place not only inside the discharge line and the tank but also inside the crankcase. Therefore, the sensor may be provided within the crankcase to detect occurrence of an abnormality.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements and, of which.

DESCRIPTION OF THE PREFERRED EMBODIMENTS

Embodiments of the present invention will be described hereinunder in detail with reference to the accompanying drawings.

Figure 1:
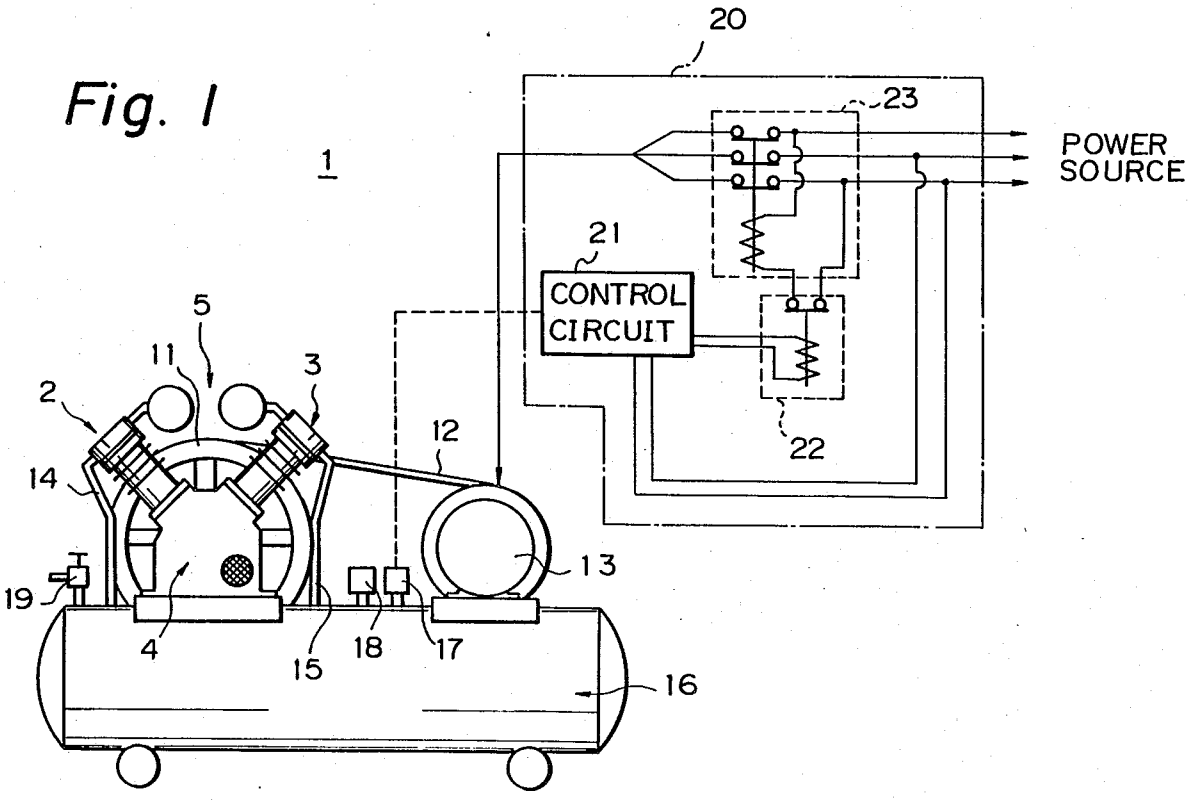
FIG. 1 shows the arrangement of a first embodiment of the compressor according to the present invention.

Referring first to FIG. 1, which shows a first embodiment of the present invention, a compressor 1 is a two-cylinder compressor having two cylinders 2 and 3. The cylinders 2 and 3 are secured to a crankcase 4. The cylinders 2, 3 and the crankcase 4 constitute in combination a compressor body 5. Inside the compressor body 5 are disposed pistons 6, connecting rods 7, a crankshaft 8, etc. (see FIG. 2 which shows the compressor body 5 with a broken connecting rod 7). The top of each of the cylinders 2 and 3 is provided with air valves 9 and 10 which operate in response to the suction and the discharge of air into and from the cylinder.

The pistons 6 are connected to the crankshaft 8 through the respective connecting rods 7. One end of the crankshaft 8 projects from the crankcase 4, and a pulley 11 is attached to the projecting end portion. The pulley 11 is connected to a motor 13 through a belt 12. Thus, the pistons 6 are driven by the motor 13 so as to reciprocate within the respective cylinders 2 and 3, thereby producing compressed air in cooperation with the air valves 9 and 10. Compressed air produced in the cylinders 2 and 3 is delivered to an air tank 16 through discharge pipes 14 and 15 so as to be accumulated therein. The compressor body 5 and the motor 13 are mounted on and rigidly secured to the air tank 16.

In addition, the air tank 16 is provided with a pressure sensor 17, a pressure switch 18 and a discharge valve 19. The pressure sensor 17 detects the level of pressure inside the air tank 16 and generates a pressure signal. The pressure switch 18 is a valve which is opened when the level of pressure inside the air tank 16 reaches a predetermined value. However, the pressure switch 18 is not needed if the pressure sensor 17 and a safety device 20 which will be explained hereinafter are arranged so as to perform this pressure control function in combination with each other. An apparatus which is to be supplied with compressed air is connected to the discharge valve 19. It should be noted that the compressor 1 according to the present invention is arranged such that the running thereof is controlled on the basis of a pressure signal output from the pressure sensor 17.

The motor 13 and the pressure sensor 17 are connected to a safety device 20. The safety device 20 comprises a control circuit 21, a relay 22, a magnetic switch 23, etc. The motor 13 is supplied with electric power via the safety device 20. The supply of power to the motor 13 is controlled by the ON/OFF operation of the magnetic switch 23. Thus, the motor 13 is controlled by the safety device 20 and, in consequence, the pistons 6, the connecting rods 7 and the crankshaft 8, which are disposed within the compressor body 5, are also controlled by the safety device 20. The ON/OFF operation of the magnetic switch 23 is determined by the switching operation of the relay 22. The relay 22 is activated in response to start and stop signals supplied from the control circuit 21.

The control circuit 21 comprises a calculating means, a timer, a memory means and a comprising means. The control circuit 21 is arranged to control the level of pressure inside the tank 16 by properly switching over the running conditions of the compressor 1 from the load running to the no-load running or reversely by turning ON or OFF the motor 13 in accordance with a pressure signal output from the pressure sensor 17 when the compressor 1 is running. The control circuit 21 also analyzes the condition of the change in pressure inside the tank 16 to judge whether the compressor 1 is running in a normal state or whether there is an abnormality in the compressor 1 and thereby suspend the motor 13 instantaneously when it is judged that there is an abnormality, for example, breakage of a connecting rod 7.

Figure 3:
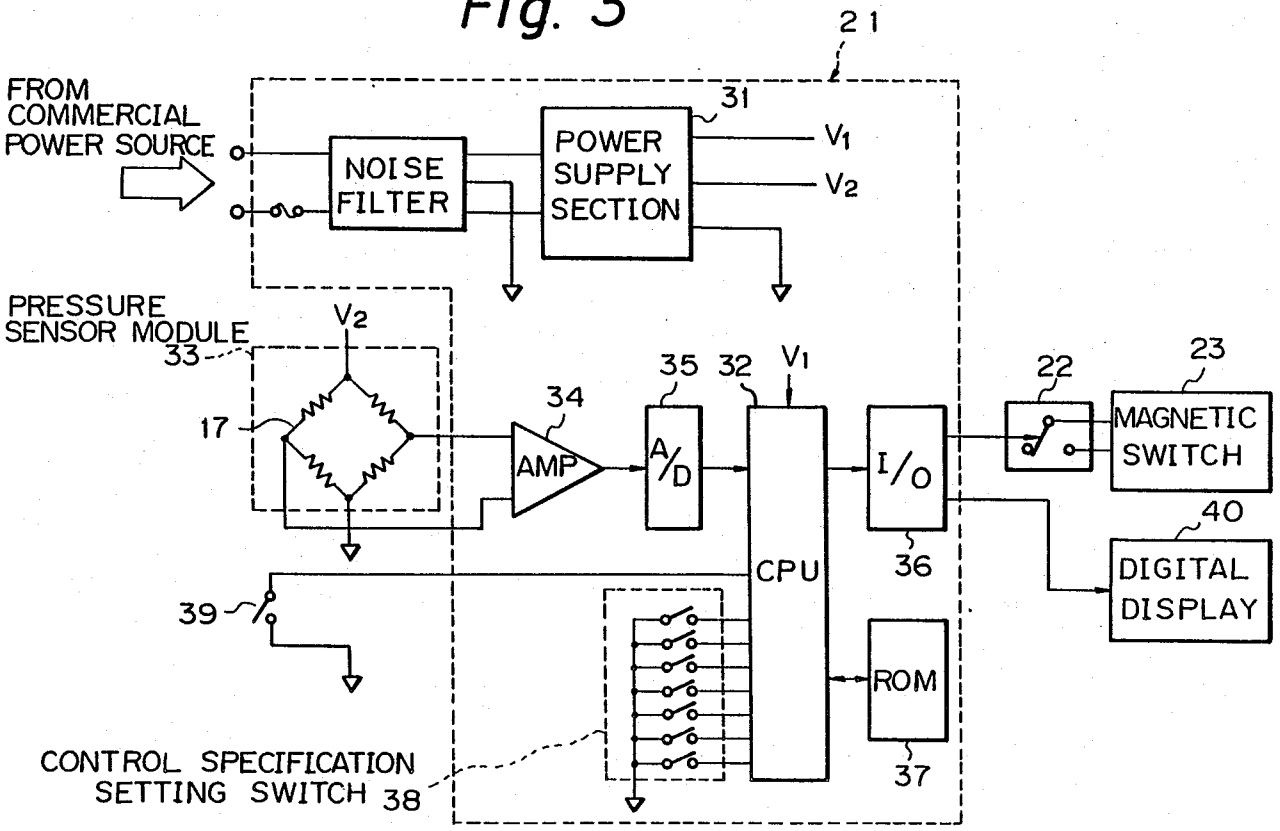
FIG. 3 is a block diagram showing one example of a safety device which may be employed in the compressor according to the present invention.

FIG. 3 is a block diagram of the safety device 20. A power supply section 31 is fed from a commercial power source and prepares two power supply voltages $V_1$ and $V_2$ which are supplied to a CPU 32 and a pressure sensor module 33, respectively. The pressure sensor module 33 outputs a signal corresponding to a level of pressure detected by the pressure sensor 17. The signal output from the pressure sensor module 33 is input to the CPU 32 through an amplifier 34 and an A/D converter 35. The CPU 32 outputs a signal for controlling the relay 22 through an interface 36, thereby controlling the ON/OFF operation of the magnetic switch 23. A ROM 37 is stored with a plurality of control specifications which have been set with the following various factors taken into consideration, that is, the capacity of the compressor 1, the load capacity and operating conditions of an apparatus which is to be connected to the discharge valve 19, etc. Thus, by properly selecting one of the control specification setting switches 38, one of the control specifications is read into the CPU 32 and the selected control specification is set. It should be noted that the reference numeral 39 denotes a compressor operating switch, and a digital display 40 for digitally displaying the level of pressure inside the tank 16, the display 40 being provided when it is necessary to display digitally the level of pressure inside the tank 16. One or more pressure sensor modules 33 may be additionally provided, if necessary.

In a normal running of the compressor 1, when the level of the pressure inside the air tank 16 falls to a predetermined value as a result of consumption of the compressed air accumulated in the tank 16, the control circuit 21 detects this fact on the basis of a pressure signal supplied from the pressure sensor 17 and then supplies a start signal to the relay 22 so as to close the magnetic switch 23. In consequence, the motor 13 is supplied with power to start rotating, thus causing the pistons 6 to start reciprocating. As a result, compressed air is delivered to the air tank 16. When the level of the pressure inside the air tank 16 rises to a predetermined value, the control circuit 32 detects this fact through the pressure sensor 17 and then supplies a stop signal to the relay 22 so as to open the magnetic switch 23. In consequence, the rotation of the motor 13 is suspended and the supply of compressed air from the compressor body 5 to the air tank 16 is also suspended. Thus, the pressure of compressed air inside the air tank 16 is controlled by the control circuit 21 so that the level of pressure is within a predetermined range at all times.

Figure 2:
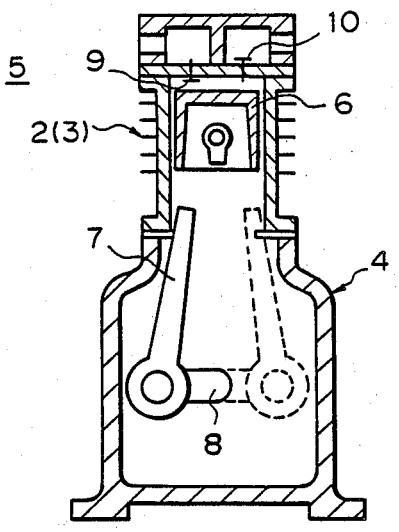
FIG. 2 is a sectional view of the compressor body with a connecting rod thereof broken.

The following is a description of the operation of the control circuit 21 that is conducted when an abnormality occurs, which is an essential part of the present invention. The term "abnormality" is employed to mean a failure or accident, for example, breakage of a connecting rod 7 as shown in FIG. 2, or malfunction of an air valve 9 or 10 due to breakage thereof. If such an accident occurs, compressed air is not properly supplied to the air tank 16. Therefore, it is possible to detect occurrence of an abnormality by detecting whether or not compressed air is being properly supplied to the air tank 16.

Figure 4:
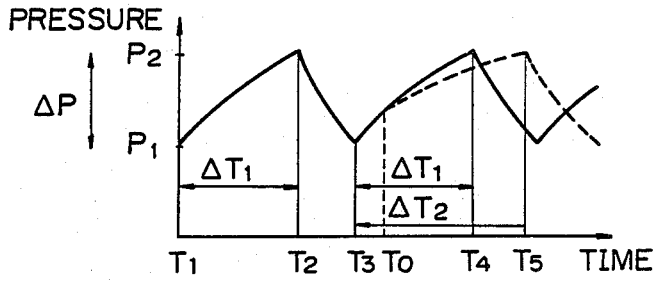
FIGS. 4(A) and 4(B) show changes in the pressure inside the air tank in relation to the motor running condition.
Figure 4:
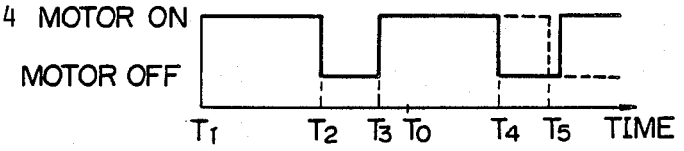

FIG. 4(A) is a chart showing the change in pressure inside the air tank 16 that is detected by the pressure sensor 17. FIG. 4(B) is a chart showing the running conditions of the motor 13 in correspondence with FIG. 4(A). In FIG. 4(A), $P_1$ denotes a lower-limit level of pressure. The arrangement is such that, when the level of pressure inside the air tank 16 becomes equal to or lower than the pressure level $P_1$ as a result of consumption of the compressed air, the control circuit 21 starts the motor 13 to thereby supply compressed air to the air tank 16 from the compressor body 5. $P_2$ denotes an upper-limit level of pressure, and when the level of pressure inside the air tank 16 becomes equal to or higher than the pressure level $P_2$, the control circuit 21 suspends the motor 13.

The solid line in FIG. 4(A) shows the change in pressure inside the air tank 16 that takes place when the compressor 1 is running in a normal state. Referring to FIG. 4(A), when the level of pressure inside the tank 16 becomes equal or lower than $P_1$ at the time $T_1$ and the motor 13 is therefore started by the control circuit 21, the pressure inside the tank 16 rises gradually and, when the level of pressure reaches $P_2$, the motor 13 is suspended, as described above (the time at which the motor 13 is suspended being denoted by $T_2$). The period of time $\Delta T_1$ during which the motor 13 is being driven is a generally constant time period in certain running conditions. Various periods of time $\Delta T_1$ corresponding to respective running conditions are memorized in the ROM 37. One time period $\Delta T_1$ is read out from the ROM 37 by properly actuating one of the control specification setting switches 38, as described above, and this time period stored in the memory means within the control circuit 21 as being one item of the selected control specification. It should be noted that each $\Delta T_1$ is determined so as to cover the range of variations which are predictable for respective operating conditions. Similarly, the pressure values $P_1$, $P_2$ and the pressure change $\Delta P$ ($\Delta P = P_2 - P_1$) are also stored in the memory means in advance as being items of each control specification.

Every time the compressed air supply process is started, the control circuit 21 measures a time (denoted by $\Delta T$) which is required for the pressure inside the tank 16 to rise from $P_1$ to $P_2$ by means of the timer incorporated therein and then calculates $\Delta P/\Delta T$ and further judges whether or not $\Delta P/\Delta T$ is equal to $\Delta P/\Delta T_1$ using the comparing means.

The compressed air accumulated in the air tank 16 is used during the period from the time $T_2$ to the time $T_3$ and the level of pressure inside the tank 16 lowers to $P_1$ or less again at the time $T_3$. After the motor 13 is started, it is assumed that the connecting rod 7 attached to one cylinder 2 of the compressor 1 is broken at the time $T_0$, as shown in FIG. 2. In such a case, the cylinder 2 becomes unable to produce compressed air, and the overall compressed air producing capacity of the compressor body 5 is halved. Accordingly, the time required to raise the pressure inside the air tank 16 to the pressure level $P_2$ is lengthened (the pressure change in this state being shown by the broken line in FIG. 4(A); the time required being shown by $\Delta T2$). For this reason, the value of $\Delta P/\Delta T2$ calculated by the calculating means is smaller than the value ($\Delta P/\Delta T_1$) obtained when the compressor 1 is running in a normal state. The control circuit 21 detects this fact in the comparing means. When a calculated value $\Delta P/\Delta T_2$ is different from a predetermined value $\Delta P/\Delta T_1$, the control circuit 21 supplies a stop signal to the relay 22 to open the magnetic switch 23, thereby suspending the motor 13. Thus, it is possible to suspend the motor 13 within a considerably short period of time ($T_5$–$T_0$) after the occurrence of an accident. It is therefore possible to reliably prevent occurrence of a secondary accident, for example, breakage of the crankcase 4 which might otherwise be caused by a collision with the broken connecting rod 7.

It should be noted that the arrangement may be such that the time $\Delta T_1$ is further divided into a plurality of time intervals $\Delta T_{1-1}$, $\Delta T_{1-2}$, . . . and control is effected using $\Delta P_1/\Delta T_{1-1}$, $\Delta P_2/\Delta T_{1-2}$, . . . for these time intervals, respectively.

The control circuit 21 may also be arranged such that a period of time $\Delta T$ which is required for the pressure inside the tank 16 to reach $P_2$ from $P_1$ is compared with a predetermined time $\Delta T_1$ in a normal running state and the motor 13 is suspended when the time $\Delta T$ is longer than $\Delta T_1$. In this case also, similar advantageous effects are provided.

Figure 5:
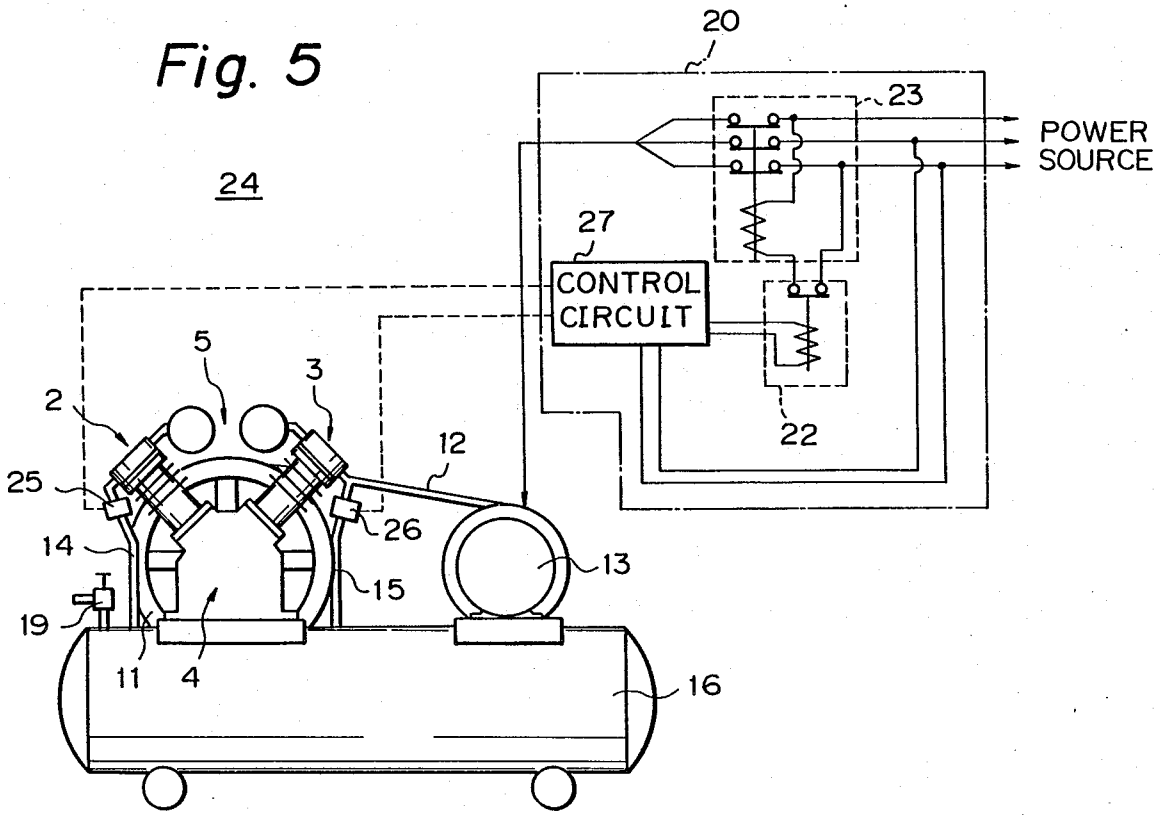
FIG. 5 shows the arrangement of a second embodiment of the compressor according to the present invention.

A second embodiment of the present invention will next be explained. Although in the first embodiment the pressure sensor 17 is provided on the air tank 16 to determine the way in which the pressure inside the tank 16 changes so as to detect occurrence of a primary accident, it is also possible to detect occurrence of an accident by means of a pressure sensor which is provided on a discharge pipe. FIG. 5 shows a compressor 24 with this alternative arrangement. It should be noted that the constituent elements of the compressor 24 shown in FIG. 5 which are the same as those of the compressor 1 shown in FIG. 1 are denoted by the same reference numerals and description thereof is omitted.

Figure 6:
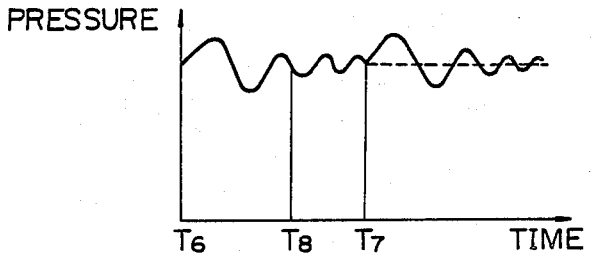
FIG. 6 is a chart showing changes in the pressure inside the discharge pipe.

In the compressor 24 shown in FIG. 5, pressure sensors 25 and 26 are disposed on the discharge pipes 14 and 15, respectively. The pressure sensors 25 and 26 are connected to a control circuit 27. The control circuit 27 also constitutes a safety device 20 such as that shown in FIG. 3 in the same way as in the case of the control circuit 21 of the first embodiment. The change in pressure inside the discharge pipe 14 that is detected by the pressure sensor 25 when the compressor 24 is running in a normal state is shown by the solid line in FIG. 6. One cycle of the cylinder 2 is shown by the interval of time from the time $T_6$ to the time $T_7$. If a primary accident, for example, breakage of one connecting rod 7, occurs at the time $T_8$, the cylinder 2 becomes unable to produce compressed air. Therefore, from the time $T_7$ at which the subsequent discharge stroke is started, there will be no change in pressure inside the discharge pipe 14, as shown by the broken line in FIG. 6. It should be noted that, since the discharge pipes 14 and 15 are individually connected to the tank 16, it is possible to ignore the effect of the other cylinder 3 on the change in pressure inside the discharge pipe 14.

A set of items of a control specification is stored in the memory means of the control circuit 27 in advance by actuating one of the control specification setting switches 38. One of such items is a pressure change behavior in a normal state. When an accident such as that described above occurs, the control circuit 27 judges from the pressure signal supplied from the pressure sensor 25 that the behavior of pressure change is different from that in the case of the normal running of the compressor 1. The control circuit 27 then supplies a stop signal to the relay 22, so that the magnetic switch 23 is opened to suspend the motor 13. Thus, with the pressure sensors 25 and 26 provided on the discharge pipes 14 and 15 it is also possible to detect occurrence of a primary accident in the early stage and thereby prevent reliably occurrence of a secondary accident.

It should be noted that the control circuit 27 is arranged to execute a similar process with respect to a pressure signal supplied from the other pressure sensor 26. Therefore, when a primary accident occurs in the cylinder 3, it is possible to suspend the compressor 24 in the early stage of failure in the same way as the above.

Figure 7:
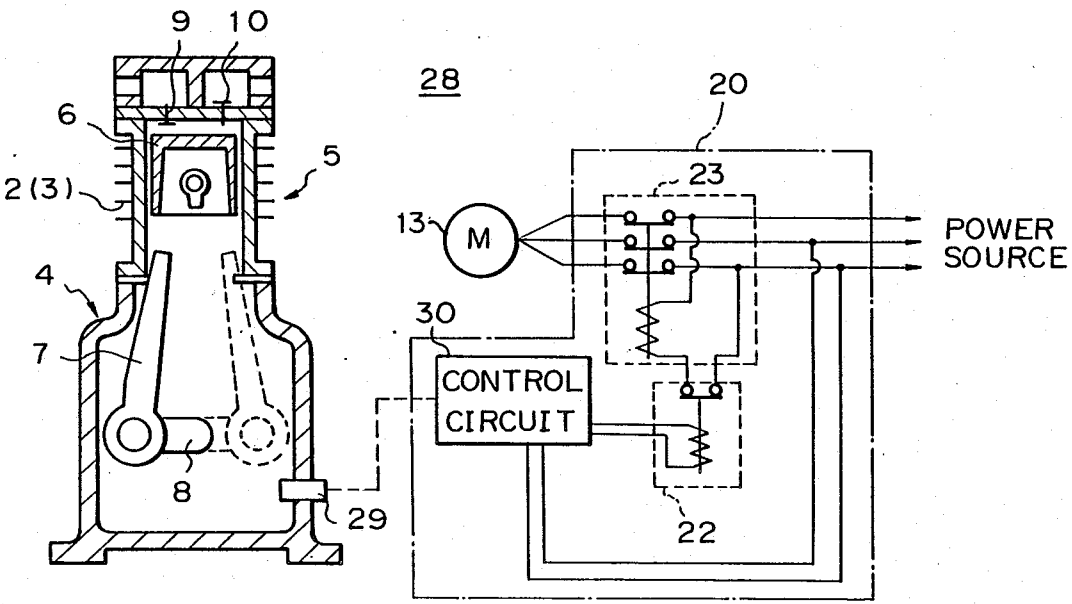
FIG. 7 shows the arrangement of a third embodiment of the compressor according to the present invention.

A third embodiment of the present invention will next be explained with reference to FIG. 7. It should be noted that in this figure also the same constituent elements as those of the compressor 1 shown in FIG. 1 are denoted by the same reference numerals, and description thereof is omitted.

A steady pressure change that takes place when the compressor is running in a normal state also occurs inside the crankcase 4. The compressor 28 shown in FIG. 7 (the illustration of the air tank 16 and other elements being omitted) is arranged such that a pressure sensor 29 is disposed on the crankcase 4 so as to detect a change in pressure inside the crankcase 4. The pressure sensor 29 is connected to a control circuit 30. The control circuit 30 also constitutes a safety device 20 such as that shown in FIG. 3 in the same way as in the case of the control circuit 21 of the first embodiment.

The pistons 6 reciprocate in the respective cylinders 2 and 3, but these cylinders 2 and 3 are attached to the crankcase 4 and communicated with each other at their respective proximal ends through the crankcase 4. Accordingly, the pressure inside the crankcase 4 also changes as the pistons 6 reciprocate in the cylinders 2 and 3.

Figure 8:
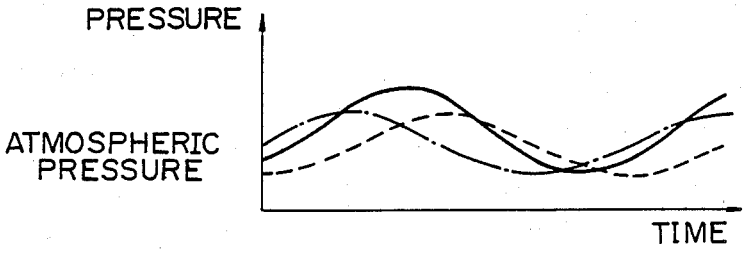
FIG. 8 is a chart showing changes in the pressure inside the crankcase.

FIG. 8 shows changes in pressure inside the crankcase 4 of the two-cylinder compressor 28 (the compressor body 5 having the same arrangement as that shown in FIG. 1 except that the pressure sensor 29 is attached thereto). In the figure, the broken line shows the change in pressure inside the crankcase 4 in the case where only the piston 6 in the cylinder 2 is reciprocated, while the one-dotted chain line shows the change in pressure inside the crankcase 4 in the case where only the piston 6 in the cylinder 3 is reciprocated. Accordingly, when the compressor 28 is running in a normal state, the pressure sensor 29 detects changes in pressure such as those shown by the solid line obtained by combining together the above-described two pressure change curves. The pressure change shown by the solid line is previously stored in the control circuit 30 as being one item of a control specification which is set by actuating one of the control specification setting switches 38.

If a primary accident, such as breakage of the connecting rod 7, occurs in the cylinder 2 (see FIG. 7), pressure changes which are detected by the pressure sensor 29 are such as those shown by the one-dotted chain line in FIG. 8. On the other hand, if a primary accident occurs in the cylinder 3, pressure changes detected by the pressure sensor 29 are such as those shown by the broken line in FIG. 8. If primary accidents occur in both the cylinders 2 and 3, no pressure change is detected.

When changes in the pressure signal supplied from the pressure sensor 29 become different from those shown by the solid line in FIG. 8, the control circuit 30 supplies a stop signal to the relay 22 to open the magnetic switch 23 to thereby suspend the motor 13. Thus, the compressor 28 is suspended immediately, so that it is possible to reliably prevent occurrence of a secondary accident.

As has been described above, the present invention enables a primary accident, for example, breakage of a connecting rod or damage of an air valve, to be detected directly and in the early stage and permits the running of the compressor to be suspended immediately after the occurrence of such an accident. Therefore, it is possible to reliably prevent occurrence of a secondary accident which may invite a serious accident and hence possible to enhance the safety and reliability of the compressor.

It should be noted that, although in the foregoing embodiments the present invention has been described by way of one example in which the invention is applied to a reciprocating compressor, it is obvious that the present invention is also applicable to other types of compressor, for example, rotary compressors.

Although the present invention has been described through specific terms, it should be noted here that the described embodiments are not exclusive and that various changes and modifications may be imparted thereto without departing from the scope of the invention which is limited solely by the appended claims.

What is claimed is:

1. A compressor comprising:

a pressure sensor installed at a predetermined position in said compressor to detect the level of pressure at said position;

memory means for storing the behavior of the continuous change of the pressure level at said predetermined position that is obtained when said compressor is running in a normal state;

means for judging the behavior of the continuous change of the pressure level actually taking place at said predetermined position on the basis of an output from said pressure sensor and making a comparison between said actual pressure change behavior and said pressure change behavior in the normal state that is stored in said memory means; and means for suspending said compressor when said actual pressure change behavior is different from said pressure change behavior in the normal state.

2. A compressor according to claim 1, which further comprises a compressor body arranged to suck and compress air and an air tank for storing the compressed air delivered from said compressor body, said pressure sensor being installed so as to detect the level of air pressure inside said air tank.

3. A compressor according to claim 1, which further comprises a compressor body arranged to suck and compress air, an air tank for storing compressed air and a pipe for delivering the compressed air from said compressor body to said air tank, said pressure sensor being installed so as to detect the level of air pressure inside said pipe.

4. A compressor according to claim 1, which further comprises a crankcase, said pressure sensor being installed so as to detect the level of air pressure inside said crankcase.

5. A compressor comprising:

a pressure sensor installed at a predetermined position in said compressor to detect the level of pressure at said position;

memory means for storing the behavior of the pressure change at said predetermined position that is obtained when said compressor is running in a normal state;

means for judging the behavior of the pressure change actually taking place at said predetermined position on the basis of an output from said pressure sensor and making a comparison between said actual pressure change behavior and said pressure change behavior in the normal state that is stored in said memory means;

means for suspending said compressor when said actual pressure change behavior is different from said pressure change behavior in the normal state; and a compressor body arranged to suck and compress air and an air tank for storing the compressed air delivered from said compressor body, said pressure sensor being installed so as to detect the level of air pressure inside said air tank.

6. A compressor comprising:

a pressure sensor installed at a predetermined position in said compressor to detect the level of pressure at said position;

memory means for storing the behavior of the pressure change at said predetermined position that is obtained when said compressor is running in a normal state;

means for judging the behavior of the pressure change actually taking place at said predetermined position on the basis of an output from said pressure sensor and making a comparison between said actual pressure change behavior and said pressure change behavior in the normal state that is stored in said memory means;

means for suspending said compressor when said actual pressure change behavior is different from said pressure change behavior in the normal state; and a compressor body arranged to suck and compress air, an air tank for storing compressed air and a pipe for delivering the compressed air from said compressor body to said air tank, said pressure sensor being installed so as to detect the level of air pressure inside said pipe.

7. A compressor comprising:

a pressure sensor installed at a predetermined position in said compressor to detect the level of pressure at said position;

memory means for storing the behavior of the pressure change at said predetermined position that is obtained when said compressor is running in a normal state;

means for judging the behavior of the pressure change actually taking place at said predetermined position on the basis of an output from said pressure sensor and making a comparison between said actual pressure change behavior and said pressure change behavior in the normal state that is stored in said memory means;

means for suspending said compressor when said actual pressure change behavior is different from said pressure change behavior in the normal state; and a crankcase, said pressure sensor being installed so as to detect the level of air pressure inside said crankcase.

* * * * *